United States Patent [19]

Welschof

[11] Patent Number: 4,843,864

[45] Date of Patent: Jul. 4, 1989

[54] PRESS TOOLING FOR MANUFACTURING CONSTANT VELOCITY RATIO UNIVERSAL JOINT MEMBERS

[75] Inventor: Hans-Heinrich Welschof, Rodenbach, Fed. Rep. of Germany

[73] Assignee: Löhr & Bromkamp GmbH, Offenbach am Main, Fed. Rep. of Germany

[21] Appl. No.: 180,364

[22] Filed: Apr. 11, 1988

[30] Foreign Application Priority Data

Apr. 10, 1987 [DE] Fed. Rep. of Germany ..... 3712301

[51] Int. Cl.[4] ..... B21D 53/88; B21K 1/76

[52] U.S. Cl. ..... 72/355; 72/344; 72/358; 72/359

[58] Field of Search ..... 72/347, 353, 354, 344, 72/345, 355, 358, 359, 400, 401, 392, 393

[56] References Cited

U.S. PATENT DOCUMENTS

| | | | |
|---|---|---|---|
| 4,406,146 | 9/1983 | Suzuki | 72/358 |
| 4,601,191 | 7/1986 | Ikeda et al. | 72/402 |
| 4,610,155 | 9/1986 | Langford et al. | 72/359 |
| 4,768,368 | 9/1988 | Langford et al. | 72/355 |

FOREIGN PATENT DOCUMENTS

| | | | |
|---|---|---|---|
| 59556 | 5/1981 | Japan | 72/393 |
| 91945 | 7/1981 | Japan | 72/427 |
| 297 | 1/1984 | Japan | 72/355 |

OTHER PUBLICATIONS

EP 0013545, Published Jul. 1980, Spannbauer 72/358.

*Primary Examiner*—Robert L. Spruill
*Attorney, Agent, or Firm*—Toren, McGeady & Associates

[57] ABSTRACT

Press tooling for manufacturing an inner or outer member of a constant velocity universal joint, with non-undercut ball-receiving tracks and, between such tracks, a part-spherical cage guiding surface, comprises a first element with radially extending ribs for forming the tracks, and a number of second elements with portions which fit between the ribs of the first element and are shaped to form the part-spherical surface of the joint member between its tracks. For forming an outer joint member the first element may have outwardly extending ribs between which the second elements fit, or for forming an inner joint member for first element may be in the form of a sleeve with inwardly extending ribs between which the second elements fit. In use, after formation of a joint member the first element can be withdrawn axially after which the operative portions of the second element can either be moved radially to disengage them from the surfaces they have formed or moved angularly about the axis of the joint member so that they occupy the tracks. Thereafter the second element can be withdrawn axially from the joint member.

14 Claims, 5 Drawing Sheets

PRESS TOOLING FOR MANUFACTURING CONSTANT VELOCITY RATIO UNIVERSAL JOINT MEMBERS

BACKGROUND OF THE INVENTION

1. Field of the Invention

This invention relates to press tooling for manufacturing outer or inner members of constant velocity ratio universal joints by deformation of workpieces. Particularly it relates to the manufacture of members for universal joints of the type wherein ball-receiving tracks in the members, spaced circumferentially about the members, are of non-undercut configuration.

In the context of an outer joint member, which is in the form of a hollow component having an open end, in referring to the ball-receiving tracks as being non-undercut we mean that the base of each track is, at a position away from the open end of the joint member, not at a greater radial distance from the rotational axis of the joint member than it is at such open end. In the context of an inner joint member, in referring to the ball-receiving tracks therein as being non-undercut we mean that, considered from one end of the member, the distance of the base of each track from the rotational axis of the member increases to a maximum but does not then decrease with increasing distance from the said end of the member.

Between the ball-receiving tracks of the joint members, the members have respective portions of a surface which may serve for guiding a cage in the completed joint and which may be of part-spherical configuration. Such part-spherical surface portions are not, of course, non-undercut.

2. Description of Prior Art

One form of press tool for forming joint outer members is known from DE-2830275, the tool comprising an inner mandrel or expander element with a conical end region, and a number of segments disposed therearound and movable axially relative thereto. The segments have external surfaces which may be part-spherical to form part-spherical surface portions of the interior of the outer joint member, and internal surfaces which co-operate with the expander mandrel. In use, the material of a workpiece is deformed around the tool while the mandrel is holding the segments in their expanded condition, by pressing the workpiece in or through a die. Thereafter the expander mandrel is withdrawn from the segments, permitting them to be displaced radially inwardly to disengage them from the surfaces formed thereby, after which they can be withdrawn from the finished article. One disadvantage of this design of tool is that when the segments are in their expanded condition gaps exist therebetween, into which the material of the workpiece can flow during its deformation. Subsequently, machining is necessary to remove such material.

A similar tool is known from DE-3004024, which differs slightly in that the segments of the tool are shaped to form part of the ball-receiving tracks as well as the cage guiding surfaces. The dividing line between each adjacent pair of segments of the tool is positioned in the centre of a ball-receiving track. This tool also has the disadvantage that it is necessary subsequently to machine the ball tracks of a joint member produced by it.

SUMMARY OF THE INVENTION

It is broadly the object of the present invention to provide a tool which eliminates the need for subsequent machining, e.g. grinding, of parts of the operative surfaces of the joint members, at least in the region of the ball tracks. Embodiments of tool according to the invention as described hereafter are capable of producing both joint inner members and joint outer members.

All the embodiments of tool according to the invention have the characteristic that the ball-receiving tracks of the joint member are formed by a one-piece solid element of the tool which does not require to be distorted or to change its configuration in use. Therefore it is capable of withstanding high forces, and the ball tracks produced thereby are highly precise such as not to require subsequent machining.

According to one aspect of the present invention, we provide a press tooling assembly for making an inner or outer member of a constant velocity ratio universal joint by deformation of a workpiece, the joint member comprising a number of ball-receiving tracks spaced circumferentially about the rotational axis of the member and extending axially of the member so as to be of non-undercut configuration considered from one end of the member, the member further comprising, between said tracks, portions of a part-spherical surface for cage guidance, the tooling assembly comprising:

- a first element comprising a number of radially extending circumferentially spaced rib formations having a shape corresponding to and adapted to form the tracks in the joint member and defining spaces therebetween;
- a number of second elements spaced circumferentially about the first element and having portions having a shape corresponding to and adapted to form said part-spherical surface portions of the joint member, said second elements being movable axially relative to the first elements between a first position wherein said portions of said second elements occupy said spaces to define a surface corresponding to the required configuration of the joint member, and a second position wherein said portions are withdrawn from said spaces;
- means for effecting deformation of said workpiece to cause its shape to conform to said surface of the first and second elements while they are in their first relative axial position;
- means for effecting axial movement of said first element relative to the deformed workpiece, to withdraw said rib formations of the first element from the tracks formed thereby;
- means permitting movement of said second elements relative to said deformed workpiece, to disengage said portions thereof from said part-spherical surface portions formed thereby;
- and means permitting subsequent axial movement of said second elements relative to said deformed workpiece to withdraw them from the workpiece.

In use of tooling according to the invention, deformation of a workpiece to form a universal joint member is carried out while the first and second elements of the tooling are in their first axial position relative to one another. When an outer joint member is being made, a workpiece of hollow configuration having an open end may be used, the first and second elements of the tool being positioned within such workpiece which is then pressed axially through an outer tool part or die, to cause the workpiece to close onto the first and second elements and conform to their shape. When an inner joint element is being made a generally star-shaped workpiece may be place within the first and second elements of the tool when they are in their first relative axial position, the workpiece being deformed by a ram or rams acting axially on the ends of the workpiece.

When the joint member has been formed, the first element can be withdrawn axially therefrom, which is possible because the rib formations and the tracks formed thereby are of non-undercut configuration. Subsequently the second elements can be moved relative to the deformed workpiece, to disengage their portions from the part-spherical surface portions formed thereby, and subsequently the second elements can be withdrawn from the workpiece axially.

An important feature of the invention is that, when they are in their first relative axial position, the first and second elements of the tool may define a substantially complete surface corresponding to the required configuration of the joint member, with no circumferential gaps between the rib formations of the first element and the portions of the second elements. By this means flow of metal into gaps, which requires subsequent machining of the formed joint member to remove the burrs thus formed, is avoided. Preferably the rib formations of the first element, and the portions of the second elements, abut one another in regions which are transitional between the ball-receiving tracks and the part-spherical portions between the tracks of a joint member.

The first and second elements may be provided with stop means which are operable so that axial movement of the second elements relative to the workpiece is controlled by axial movement of the first element. Suitable abutments or spring assemblies may be provided for this purpose. However, independent control of the first and second elements is possible.

The second elements may be supported such that the said portions thereof are movable radially when they are to be disengaged from the part-spherical surface portions of the joint member formed thereby. For example, the second elements may be integral with and flexibly supported by an annular connecting member or collar.

Alternatively, the second elements may be rigidly supported, and may be arranged to be moved angularly about the axis of the deformed workpiece to disengage them from the surface portions that they have formed. For this, it is necessary that the portions of the second elements each have a circumferential dimension which is smaller than the circumferential dimension of a base portion of each rib formation of the first element of the tool. This ensures that, after the first element has been withdrawn from the workpiece, the formations of the second elements will fit into the tracks which have been formed by the rib formations of the first element. The second elements may be moved angularly on their own, or together with the first element which has been previously withdrawn from the deformed workpiece.

According to a further aspect of the invention, we provide a press tool for making an outer member of a constant velocity ratio universal joint, by deformation of a workpiece in a die with the press tool extending into a cavity in the workpiece from an open end thereof, the joint member comprising a number of ball-receiving tracks spaced circumferentially about the rotational axis of the member and extending axially thereof so as to be of non-undercut configuration considered from the open end of the member, the member further comprising, between said tracks, portions of a surface for cage guidance, the press tool comprising:

a first, inner, element comprising a number of radially outwardly extending circumferentially spaced rib formations having a shape corresponding to and adapted to form the tracks in the joint member;

and a number of second elements spaced circumferentially about the first element and having portions having a shape corresponding to and adapted to form said cage-guidance surface portions of the joint member;

said first element being movable axially relative to said second elements between a first position, wherein said portions of the second elements occupy spaces between the ribs of the first element, and a second position, wherein said ribs are withdrawn from between said portions of the second elements;

and said second elements being supported such that said portions thereof are movable radially inwardly when the first and second elements are in their second relative axial position.

According to yet a further aspect of the invention, we provide a press tool for making an outer member of a constant velocity ratio universal joint, by deformation of a workpiece in a die with the press tool extending into a cavity in the workpiece from an open end thereof, the joint member comprising a number of ball-receiving tracks spaced circumferentially about the rotational axis of the member and extending axially thereof so as to be of non-undercut configuration considered from the open end of the member, the member further comprising, between said tracks, portions of a surface for cage guidance, the press tool comprising:

a first, inner, element comprising a number of radially outwardly extending circumferentially spaced rib formations having a shape corresponding to and adapted to form the tracks in the joint member;

and a number of second elements spaced circumferentially about the first element and having portions having a shape corresponding to and adapted to form said cage-guidance surface portions of the joint member;

said first element being movable axially relative to said second elements between a first position, wherein said portions of the second elements occupy spaces between the ribs of the first element, and a second position, wherein said ribs are withdrawn from between said portions of the second elements;

and said second elements further being movable angularly about said first element, each of said portions of the second elements having a circumferential dimension smaller than the circumferential dimension of the base portion of each of said rib formations of the first element.

According to yet a further aspect of the invention, we provide a press tool for making an inner member of a constant velocity ratio universal joint by deformation of a generally star-shaped workpiece, the joint member comprising a number of ball-receiving tracks spaced circumferentially about the rotational axis of the member and extending axially thereof so as to be of non-undercut configuration considered from one end of the member, the member further comprising, between said tracks, portions of a surface for cage guidance, the tool comprising:

a first element in the form of a sleeve having a number of radially inwardly extending circumferentially spaced rib formations which have a shape corresponding to and adapted to form the tracks in the joint member;

and a number of second elements spaced circumferentially about the first element and having portions which have a shape corresponding to and adapted to form said cage-guiding surface portions of the joint member;

said first and second elements being movable axially relative to one another between a first position, wherein said portions of the second elements occupy spaces between said rib formations of the first element, to define a surface corresponding to the required configuration of the joint member, and a second position wherein said portions of said second element are withdrawn from said spaces of the first element;

and said second elements further being supported such that said portions thereof are movable radially outwardly when the first and second elements are in their second relative axial position.

According to yet a further aspect of the invention, we provide a press tool for making an inner member of a constant velocity ratio universal joint by deformation of a generally star-shaped workpiece, the joint member comprising a number of ball-receiving tracks spaced circumferentially about the rotational axis of the member and extending axially thereof so as to be of non-undercut configuration considered from one end of the member, the member further comprising, between said tracks, portions of a surface for cage guidance, the tool comprising:

a first element in the form of a sleeve having a number of radially inwardly extending circumferentially spaced rib formations which have a shape corresponding to and adapted to form the tracks in the joint member and defining spaces therebetween;

an ejector ram provided with a number of second elements spaced circumferentially about the first element and having portions with a shape corresponding to and adapted to form said cage-guidance surface portions of the joint member;

said ejector ram being movable axially relative to said first element, between a first position, wherein said second elements occupy said spaces between said ribs, and a second position wherein said second elements are withdrawn from said spaces;

said portions of said second elements each having a circumferential dimension smaller than the circumferential dimension of a base portion of each of said rib formations of the first element.

BRIEF DESCRIPTION OF THE DRAWINGS

The invention will now be described by way of example with reference to the accompanying drawings, of which.

DESCRIPTION OF PREFERRED EMBODIMENTS

Figure 1C:
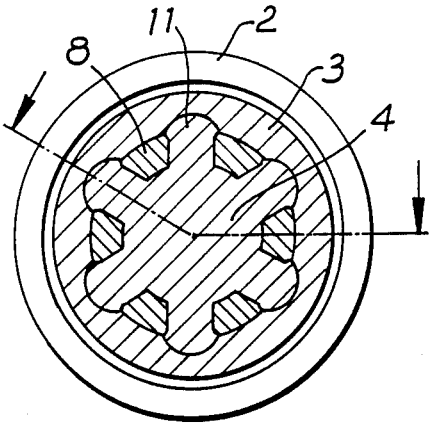
FIG. 1C is a transverse section through the tool, on the section line shown in FIG. 1A.
Figure 1A:
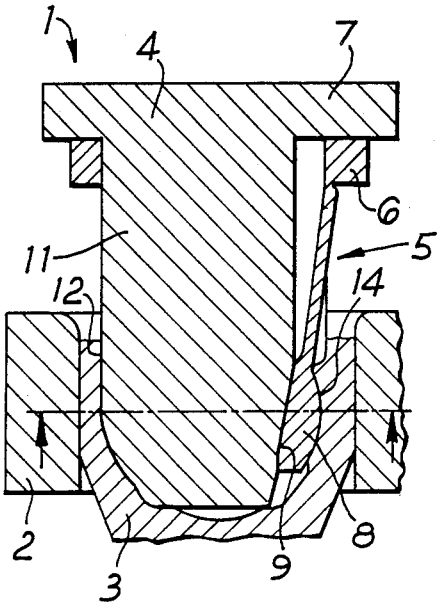
FIG. 1A is an axial section through a first embodiment of tool according to the invention, in one operative position.
Figure 1B:
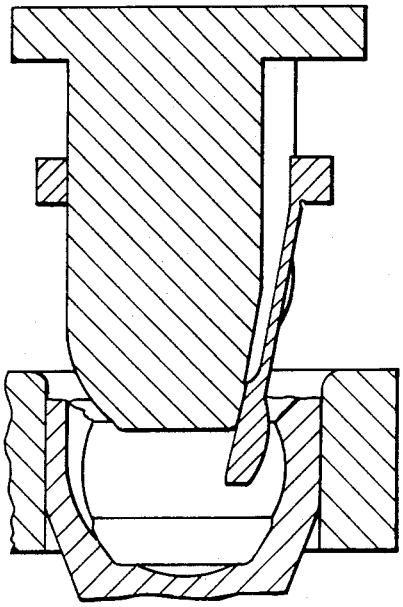
FIG. 1B is an axial section through the tool in a different operative position.

Referring firstly to FIGS. 1A, 1B and 1C of the drawing, this shows a press tool assembly for manufacture of the outer member of a constant velocity ratio universal joint. There is a tool indicated generally at 1 and a outer tool part or die 2. The tool 1 comprises a first element 4, comprising a number of radially outwardly extending circumferentially spaced ribs 11, and a number of second elements 5 disposed circumferentially about the first element 4. The second elements 5 are in the form of fingers which are joined integrally at their upper end by an annular collar 6, the free ends of the fingers terminating in portions 8. The fingers are connected to the collar 6 by portions of reduced cross-sectional area of material, so that the fingers can move angularly about their upper ends so that the portions 8 thereof move radially relative to the axis of the tool which is also the axis of rotation of a joint member made thereby.

Figure 3C:
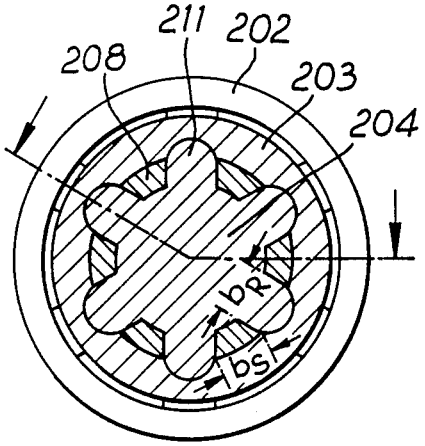
FIGS. 3C and 3D are respectively transverse sections through the tool of the invention, in different operative positions according to the section lines shown on FIGS. 3A and 3B.

The first element 4 and second elements 5 are movable axially relative to one another between the positions of FIGS. 1A and 1B. In FIG. 1A, the portions 8 of the elements 5 lie between the radially outwardly extending ribs 11 of the first element 4, which ribs 11 have an outside surface 12 which is shaped to form undercut-free ball-receiving tracks in the joint outer member. The portions 8 have external surfaces 14 which are shaped to form part-spherical cage guiding surface portions between the ball-receiving tracks in the outer joint member. Between the ribs 11, the first element 4 has respective part frusto-conical surface portions 9 which form support surfaces for correspondingly shaped part-frusto-conical surfaces at the inside of the portions 8. It will be noted that, as clearly seen in the section of FIG. 3C, when the first and second elements of the tool are in the relative axial position of FIG. 1A they define a complete external surface corresponding to the required internal surface of the outer joint member, i.e. there are no gaps between the ribs 11 and portions 8 of the second elements into which material of a workpiece could flow during its deformation.

In the other relative axial position of the first and second tool elements, as shown in FIG. 1B, the first tool element 4 is at least partially withdrawn from between the portions 8 of the second elements 5. This permits the portions 8 of the second elements to move radially inwardly, to disengage them from the part-spherical surface portions formed thereby in an outer joint member. The portions 8 may spring inwardly when the first element 4 is withdrawn from between them.

In use of the tool of FIGS. 1A–1C, the first and second elements 4, 5 would be be brought to their relative axial position as shown in FIG. 1A. They would then be introduced into a suitable blank workpiece which is to be deformed into an outer joint member. The deformation would be carried out by effecting relative axial movement between the die 2 and the workpiece having the tool elements therein. This produces the situation shown in FIG. 1A, where the workpiece has been deformed to cause its internal shape to conform to the shape of surfaces 12, 14.

Thereafter, the first tool element 4 can be withdrawn from the formed joint outer member. This axial withdrawal of the tool element is possible because the ball-receiving tracks formed thereby are of non-undercut configuration, considered from the open end of the joint outer member. After such withdrawal of the first tool element, the second tool elements 5 are free for their portions 8 to be displaced radially inwardly, to disengage them from the part-spherical surface portions formed thereby. Thereafter these second tool elements can be withdrawn from the finished outer joint member, to reach the relative position shown in FIG. 1B.

Figure 2C:
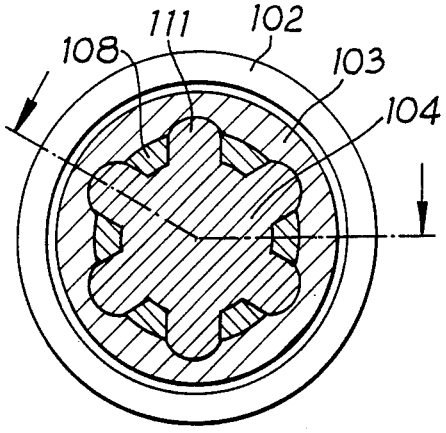
FIGS. 2A, 2B and 2C are views as FIGS. 1A, 1B and 1C, of a further embodiment of tool according to the invention.
Figure 2A:
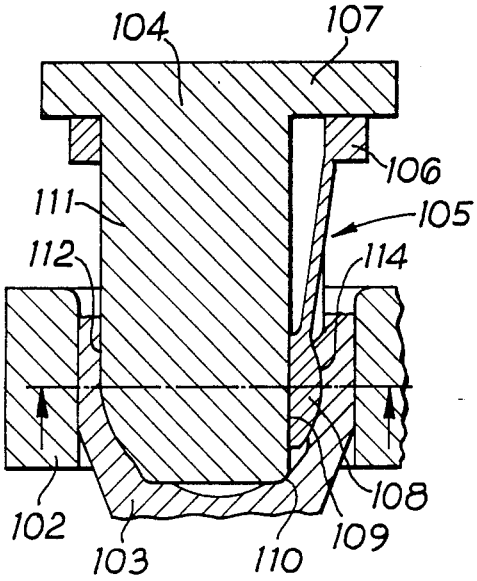
Figure 2B:
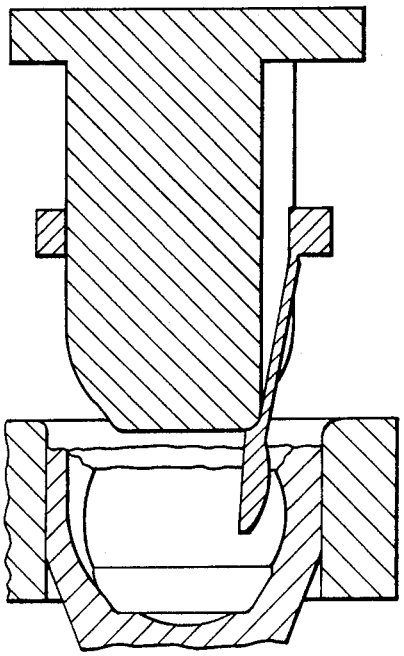

Referring now to FIGS. 2A–2C of the drawings, this shows a tool assembly which is basically similar to that of FIGS. 1A–1C. The same reference numbers in the 100 series are used for corresponding parts. The difference from FIG. 1 is that, in this embodiment, the portions 108 of the second tool elements 105 have part-cylindrical internal surfaces, and the first tool element 104 has, between its ribs 111, respective part-cylindrical support surfaces 109. At its lower free end, the first tool element 104 has a tapered lead in surface 110 to co-operate with a corresponding shaped surface adjacent the portions 108 of the second tool elements, when the tool elements are in the relative axial position shown in FIG. 2B.

Also, in the transverse cross-section shown in FIG. 2C, it will be seen that the ribs 111 are parallel sided right to their outermost edges, whereas the ribs 11 in the embodiment of FIGS. 1A–1C are different.

Referring now to FIGS. 3A–3D of the drawings, this shows press tooling whose main parts have a certain similarity with the embodiments of FIGS. 1A–1C and 2A–2C, and once again corresponding parts are accorded corresponding reference numerals but in the 200 series. In this embodiment, however, the second tool elements in the form of fingers 205 are integral with and rigidly attached to a collar 206, so that they are not capable of being deflected so that the portions 208 at their free ends move radially inwardly. Therefore, to enable the withdrawal of the portions 208 from a finished outer joint member 203, provision has been made for the assembly of the second tool elements 205 to be moved angularly about the axis of the joint member. The maximum circumferential dimension bs of each portion 208 is smaller than the circumferential dimension br of each rib formation 211.

Figure 3D:
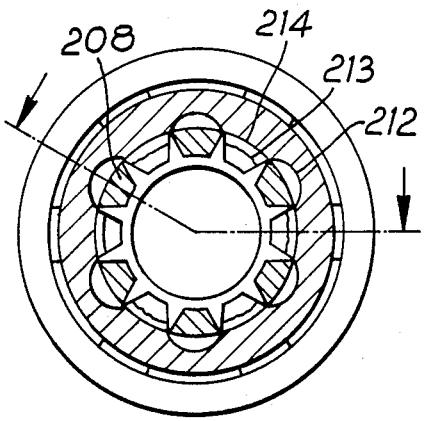
Figure 3A:
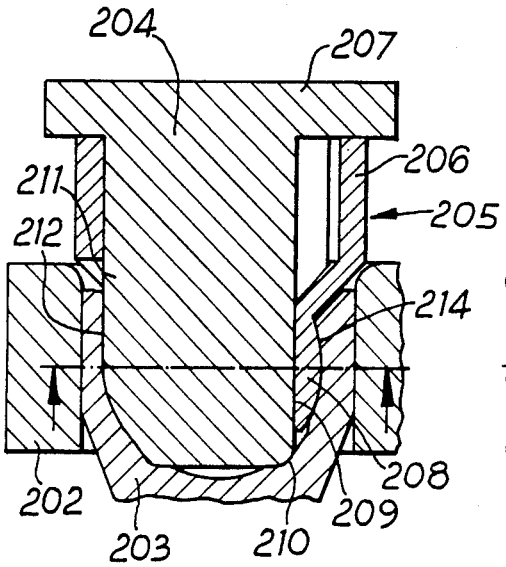
FIGS. 3A is an axial section through a further embodiment of tool according to the invention, in one operative position.
Figure 3B:
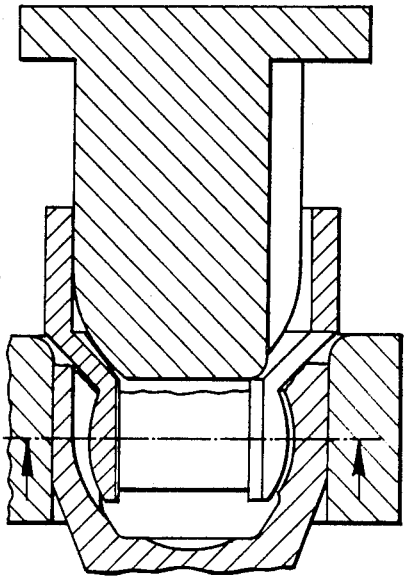
FIG. 3B is an axial section of the tool of FIG. 3A, in another operative position.

In use, after formation of the outer joint member and attainment of the condition shown in FIG. 3A, the first tool element 204 can be withdrawn upwardly along the axis of the tool. Thereafter, the assembly of second tool elements 206 is moved angularly until the relative position shown in section in FIGS. 3B and 3D is reached, with the portions 208 occupying the spaces formally occupied by the ribs 211. It is then possible to withdraw the portions 208 axially from the outer joint member.

Referring now to the views comprising FIGS. 4A–4D of the drawings, this shows tooling for making an inner joint member. There is a first tool element in the form of a sleeve 15, an upper ram 16, a lower (ejector) ram 17, and second tool elements 18 which are in the form of fingers integral with and extending downwardly from a collar 22 on the ram 16, being connected thereto by regions of reduced material cross-section to permit radial movement of the lower ends of the fingers. Each of the second elements 18 has at its lower end a portion 21 with an internal surface 23 for forming a part-spherical cage guiding surface on an inner joint member (30) to be formed by use of the tool. Each portion 21 fits axially into a groove 20 defined between circumferentially spaced radially inwardly extending ribs 19 provided in the first tool element 15. The ribs 19 have surfaces 25 shaped to form ball receiving tracks in the inner joint member, which tracks are undercut-free considered from the end of the inner joint member which is lowermost in the drawing.

Figure 4C:
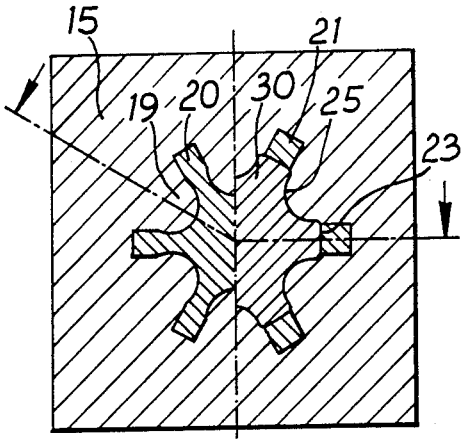
FIGS. 4A, 4B, 4C and 4D are sections as FIGS. 3A, 3B, 3C and 3D, of yet a further embodiment of tool according to the invention.
Figure 4D:
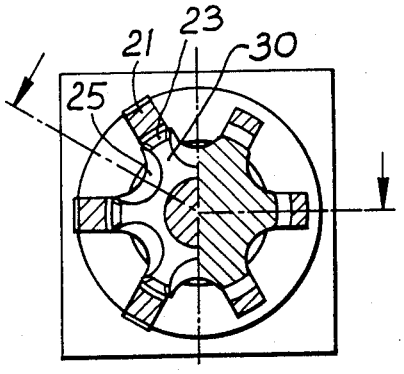
Figure 4A:
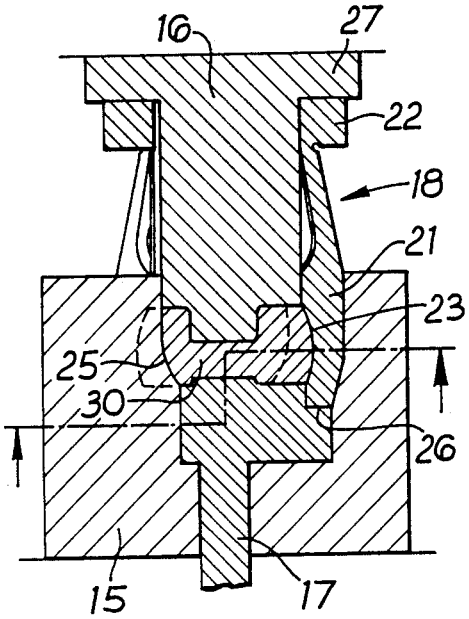
Figure 4B:
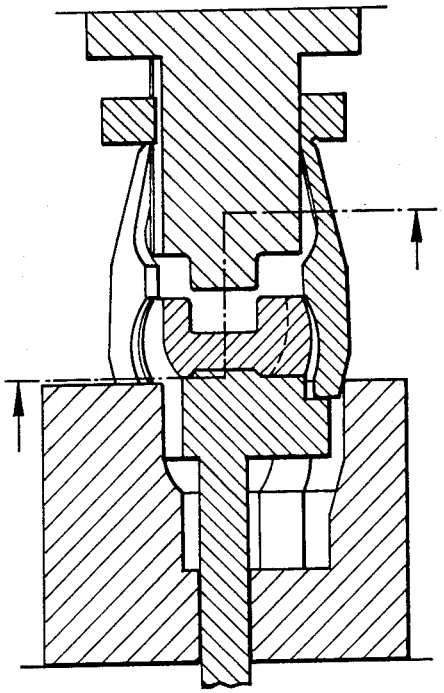

In use of the tooling, a blank workpiece of generally star-shaped configuration would be introduced so as to rest on the ejector 17, which is within the first tool element 15 as shown in FIG. 4A. At this time, the second tool elements 18 are also in the position shown in FIG. 4A, with their portions 21 between the ribs 19 of the tool element 15. Thereafter the upper ram 16 would be lowered to deform the workpiece into a joint member 30, with its external shape conforming to the internal shape of the surfaces 25, 23.

It will be noted that the elements 18 have abutment surfaces 26 at their lowermost ends which engage the ejector 17. Further, the upper ram 16 has an annular portion 27 which abuts the collar 22 joining the second elements 18. Therefore, as the workpiece is formed into the inner joint member, the portions 21 of the elements 18 are firmly held in the required position relative to the first element 15, in the direction axially of the joint member.

After such formation of a joint member, the upper ram 16 would be raised, and the ejector ram 17 would also be raised. The latter moves both the portions 21 of the second elements 18, and the formed inner joint member 30, axially out of the first tool element 15. This is possible by virtue of the non-undercut configuration of the ball-receiving tracks formed by ribs 19 and their surfaces 25. As soon as the portions 21 of the elements 18 are clear of the element 15, the portions 21 can be moved radially outwardly to disengage them from the part-spherical surfaces formed by their internal surfaces 23. Thereafter, the elements 18 can be moved axially relative to the formed inner joint member, leaving the latter totally free. The portions 21 may spring outwardly as soon as they are clear of the element 15.

Referring now to FIGS. 5A–5D of the drawings, this shows a further embodiment of tooling for making an inner joint member. Certain parts correspond to parts of the embodiment of FIGS. 4A–4D, and are therefore identified by equivalent reference numerals in the 100 series. Thus, the tooling comprises a first element 15 having inwardly extending rib formations 19, with surfaces 25 for forming non-undercut ball-receiving tracks in the inner joint member. Between the rib formations 119 there are grooves 120. There is an upper ram 116, and a lower (ejector) ram 117. This embodiment differs from the embodiment of FIG. 4 in that the ejector ram 117 has second elements 129 integral therewith, with portions with internal surfaces 123 for forming cage guiding surfaces between the tracks of the inner joint member. Each of the elements 29 has a circumferential dimension bn smaller than the circumferential dimension br of the base portion of each rib 19 and hence of the track formed thereby in the inner joint member.

Figure 5C:
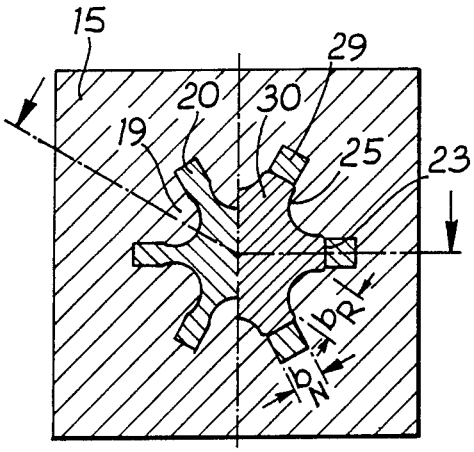
FIGS. 5A, 5B, 5C and 5D are further views as FIGS. 3A, 3B, 3C and 3D, of yet a further embodiment of tool.
Figure 5D:
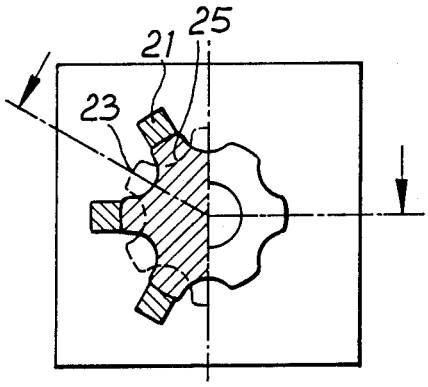
Figure 5A:
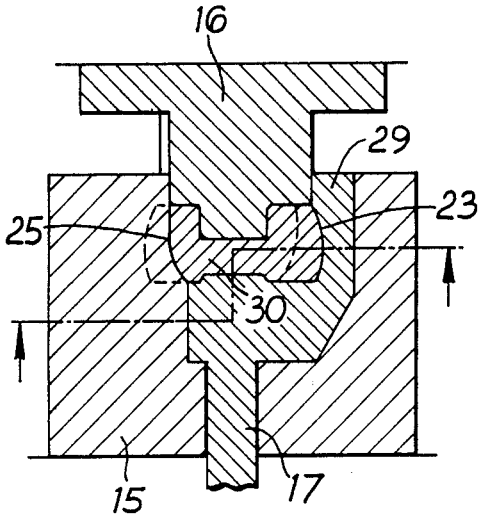
Figure 5B:
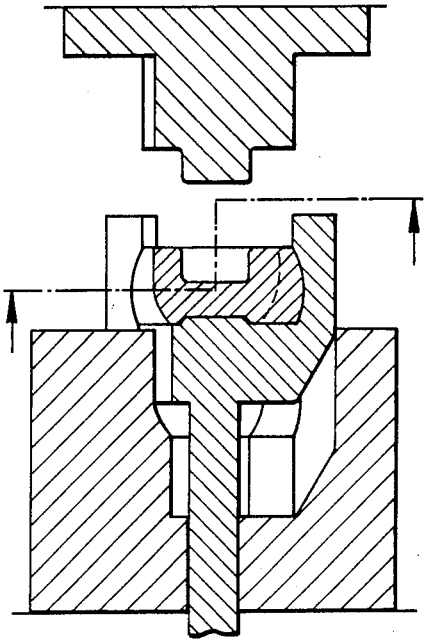

After manufacture of an inner joint member by deformation of a blank workpiece, which usually will be generally star-shaped, the ejector 17 can be raised to remove the inner joint member from the element 15, to reach the position shown in FIGS. 5B and 5D. Thereafter, to allow the inner joint member to be withdrawn from the elements 29, the joint member must be moved angularly about its axis relative to the elements 29 until the latter occupy the tracks which have been formed by the ribs 19. Thereafter the inner joint member can be withdrawn axially from the elements 29, this being possible by virtue of the aforementioned difference between the dimensions bn and br.

I claim:

1. A press tool for making an outer member of a constant velocity ratio universal joint, by deformation of a workpiece in a die with the press tool extending into a cavity in the workpiece from an open end thereof, the joint member comprising a number of ball-receiving tracks spaced circumferentially about the rotational axis of the member and extending axially thereof so as to be of non-undercut configuration considered from the open end of the member, the member further comprising, between said tracks, portions of a surface for cage guidance, the press tool comprising:

a first, inner, element comprising a number of radially outwardly extending circumferentially spaced rib formations having a shape corresponding to and adapted to form the tracks in the joint member;

and a number of second elements spaced circumferentially about the first element and having portions having a shape corresponding to and adapted to form said cage-guidance surface portions of the joint member;

said first element being movable axially relative to said second elements between a first position, wherein said portions of the second elements occupy spaces between the ribs of the first element, and a second position, wherein said ribs are withdrawn from between said portions of the second elements;

and said second elements being supported such that said portions thereof movable radially inwardly when the first and second elements are in their second relative axial position.

2. A press tool according to claim 1 wherein said first element has, between said rib formations thereof, cylindrical support surface portions, and said portions of the second elements have part-cylindrical internal surfaces which are engaged by said support surface portions when the first and second elements are in their first relative axial position.

3. A press tool according to claim 1 wherein said first element has, between said rib formations thereof, frusto-conical support surface portions, and said portions of the second elements have internal part frusto-conical surfaces which are engaged by said support surface portions when the first and second elements are in their first relative axial position.

4. A tool according to claim 1 wherein said second elements are integral with and flexibly supported by an annular part.

5. A press tool for making an outer member of a constant velocity ratio universal joint, by deformation of a workpiece in a die with the press tool extending into a cavity in the workpiece from an open end thereof, the joint member comprising a number of ball-receiving tracks spaced circumferentially about the rotational axis of the member and extending axially thereof so as to be of non-undercut configuration considered from the open end of the member, the member further comprising, between said tracks, portions of a surface for cage guidance, the press tool comprising:

a first, inner, element comprising a number of radially outwardly extending circumferentially spaced rib formations having a shape corresponding to and adapted to form the tracks in the joint member;

and a number of second elements spaced circumferentially about the first element and having portions having a shape corresponding to and adapted to form said cage-guidance surface portions of the joint member;

said first element being movable axially relative to said second elements between a first position, wherein said portions of the second elements occupy spaces between the ribs of the first element, and a second position, wherein said ribs are withdrawn from between said portions of the second elements;

and said second elements further being movable angularly about said first element, each of said portions of the second elements having a circumferential dimension smaller than the circumferential dimension of the base portion of each of said rib formations of the first element.

6. A press tool for making an inner member of a constant velocity ratio universal joint by deformation of a generally star-shaped workpiece, the joint member comprising a number of ball-receiving tracks spaced circumferentially about the rotational axis of the member and extending axially thereof so as to be of non-undercut configuration considered from one end of the member, the member further comprising, between said tracks, portions of a surface for cage guidance, the tool comprising:

a first element in the form of a sleeve having a number of radially inwardly extending circumferentially spaced rib formations which have a shape corresponding to and adapted to form the tracks in the joint member;

and a number of second elements spaced circumferentially within the first element and having portions which have a shape corresponding to and adapted to form said cage-guiding surface portions of the joint member;

said first and second elements being movable axially relative to one another between a first position, wherein said portions of the second elements occupy spaces between said rib formations of the first element, to define a surface corresponding to the required configuration of the joint member, and a second position wherein said portions of said second element are withdrawn from said spaces of the first element;

and said second elements further being supported such that said portions thereof are movable radially outwardly when the first and second elements are in their second relative axial position.

7. A tool according to claim 6 wherein said second elements are integrally with and flexibly supported by an annular member.

8. A tool according to claim 6 comprising upper and lower rams operable on end faces of the workpiece to cause said deformation thereof, said lower ram being operable on a deformed workpiece to cause said relative axial movement of said first and second elements from their first to their second positions while simultaneously ejecting said deformed workpiece from said first element.

9. A press tool for making an inner member of a constant velocity ratio universal joint by deformation of a generally star-shaped workpiece, the joint member comprising a number of ball-receiving tracks spaced circumferentially about the rotational axis of the member and extending axially thereof so as to be of non-undercut configuration considered from on end of the member, the member further comprising, between said tracks, portions of a surface for cage guidance, the tool comprising:

a first element in the form of a sleeve having a number of radially inwardly extending circumferentially spaced rib formations which have a shape corresponding to and adapted to form the tracks in the joint member and defining spaces therebetween;

an ejector ram provided with a number of second elements spaced circumferentially within the first element and having portions with a shape corresponding to and adapted to form said cage-guidance surface portions of the joint member;

said ejector ram being movable axially relative to said first element, between a first position, wherein said second elements occupy said spaces between said ribs, and a second position wherein said second elements are withdrawn from said spaces;

said portions of said second elements each having a circumferential dimension smaller than the circumferential dimension of a base portion of each of said rib formations of the first element.

10. A press tooling assembly for making an outer member of a constant velocity ratio universal joint by deformation of a workpiece, the joint member comprising a number of ball-receiving tracks spaced circumferentially about the rotational axis of the member and extending axially of the member so as to be of non-undercut configuration considered from one end of the member, the member further comprising, between said tracks, portions of a part-spherical surface for cage guidance, the tooling assembly comprising:

a first element comprising a number of radially extending circumferentially spaced rib formations having a shape corresponding to and adapted to form the tracks in the joint member and defining spaces therebetween;

a number of second elements spaced circumferentially about the first element and having portions having a shape corresponding to and adapted to form said part-spherical surface portions of the joint member, said second elements being movable axially relative to the first elements between a first position wherein said portions of said second elements occupy said spaces to define a surface corresponding to the required configuration of the joint member, and a second position wherein said portions are withdrawn from said spaces;

means for effecting deformation of said workpiece to cause its shape to conform to said surface of the first and second elements while they are in their first relative axial position;

means for effecting axial movement of said first element relative to the deformed workpiece, to withdraw said rib formations of the first element from the tracks formed thereby;

means permitting movement of said second elements relative to said deformed workpiece, to disengage said portions thereof from said part-spherical surface portions formed thereby;

and means permitting subsequent axial movement of said second elements relative to said deformed workpiece to withdraw them from the workpiece

11. A press tooling assembly according to claim 10 comprising means supporting said second elements such that said portions thereof move radially to disengage from said part-spherical surface portions formed thereby.

12. A press tooling assembly according to claim 10 wherein said portions of said second elements each have a circumferential dimension smaller than the circumferential dimension of a base portion of each rib formation, and comprising means supporting said second elements for angular movement about the axis of the deformed workpiece, to disengage said portions thereof from said part-spherical surface portions formed thereby.

13. A press tooling assembly according to claim 10 wherein said elements, when in said first relative axial position, define a substantially complete surface with no circumferential gaps.

14. A press tooling assembly according to claim 10 wherein said rib formations and said portions of said second elements abut one another in regions defining transitions between said ball-receiving tracks and said part-spherical portions of a joint member.

* * * * *